US007503396B2

(12) United States Patent
Hester

(10) Patent No.: US 7,503,396 B2
(45) Date of Patent: Mar. 17, 2009

(54) METHOD AND APPARATUS FOR EXPANDING TUBULARS IN A WELLBORE

(75) Inventor: Stephen Hermes Hester, Houston, TX (US)

(73) Assignee: Weatherford/Lamb, Houston, TX (US)

( * ) Notice: Subject to any disclaimer, the term of this patent is extended or adjusted under 35 U.S.C. 154(b) by 181 days.

(21) Appl. No.: 11/354,659

(22) Filed: Feb. 15, 2006

(65) Prior Publication Data

US 2007/0187113 A1 Aug. 16, 2007

(51) Int. Cl.
*E21B 23/00* (2006.01)

(52) U.S. Cl. ..... 166/384; 166/207; 166/216

(58) Field of Classification Search ..... 166/380, 166/384, 55, 206, 207, 217, 216
See application file for complete search history.

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,653,547 | A * | 12/1927 | Cameron | 294/86.22 |
| 1,840,379 | A * | 1/1932 | Wrighter | 166/135 |
| 1,930,825 | A | 10/1933 | Raymond | |
| 1,981,525 | A | 11/1934 | Price | |
| 2,383,214 | A | 4/1945 | Prout et al. | |
| 2,499,630 | A | 3/1950 | Clark | |
| 2,627,891 | A | 2/1953 | Clark | |
| 2,663,073 | A | 12/1953 | Bieber et al. | |
| 2,754,577 | A | 7/1956 | Maxwell | |
| 2,898,971 | A | 8/1959 | Hempel | |

(Continued)

FOREIGN PATENT DOCUMENTS

EP 0 961 007 A2 12/1999

(Continued)

OTHER PUBLICATIONS

EP Search Report, Application No. 05105467.4-2302 PCT, dated Aug. 31, 2005.

(Continued)

*Primary Examiner*—Kenneth Thompson
(74) *Attorney, Agent, or Firm*—Patterson & Sheridan, LLP

(57) ABSTRACT

Methods and apparatus enable expanding tubulars in a wellbore. In one embodiment, a method includes providing a first tubular string having an expansion member disposed at a lower end and connected with a threaded connection which will permit movement of the expansion member relative to the tubular string. The tubular string is held at the surface of the well while a second, smaller string is run into the first tubular string and engaged with the expansion member. Thereafter, the assembly including the first tubular string, expansion member and second tubular string are run to depth in a wellbore. Finally, the expansion member is urged upwards into the tubular string to expand the tubular string and bring it into frictional contact with surrounding wellbore walls. The initial expansion can be performed with a hydraulic jack and additional expansion can be performed by urging the cone upwards with the second tubular string.

31 Claims, 8 Drawing Sheets

U.S. PATENT DOCUMENTS

| | | | | |
|---|---|---|---|---|
| 3,087,545 | A | | 4/1963 | Woolley |
| 3,195,645 | A | | 7/1965 | Brown |
| 3,467,180 | A | | 9/1969 | Pensotti |
| 3,776,307 | A | | 12/1973 | Young |
| 3,785,193 | A | | 1/1974 | Kinley et al. |
| 3,818,734 | A | | 6/1974 | Bateman |
| 3,885,298 | A | | 5/1975 | Pogorowski |
| 3,911,707 | A | | 10/1975 | Minakov et al. |
| 4,069,573 | A | | 1/1978 | Rogers et al. |
| 4,090,382 | A | | 5/1978 | Schott |
| 4,127,168 | A | | 11/1978 | Hanson et al. |
| 4,159,564 | A | | 7/1979 | Cooper |
| 4,288,082 | A | | 9/1981 | Setterberg |
| 4,324,407 | A | | 4/1982 | Upham et al. |
| 4,371,199 | A | | 2/1983 | Kushner et al. |
| 4,429,620 | A | | 2/1984 | Burkhardt et al. |
| 4,483,399 | A | | 11/1984 | Colgate |
| 4,502,308 | A | | 3/1985 | Kelly |
| 4,523,880 | A | * | 6/1985 | Isler ..... 405/259.1 |
| 4,531,581 | A | | 7/1985 | Pringle et al. |
| 4,588,030 | A | | 5/1986 | Blizzard |
| 4,697,640 | A | | 10/1987 | Szarka |
| 4,706,745 | A | * | 11/1987 | Bishop et al. ..... 166/98 |
| 4,848,469 | A | | 7/1989 | Baugh et al. |
| 5,083,608 | A | | 1/1992 | Abdrakhmanov et al. |
| 5,271,472 | A | | 12/1993 | Leturno |
| 5,322,127 | A | | 6/1994 | McNair et al. |
| 5,409,059 | A | | 4/1995 | McHardy |
| 5,435,400 | A | | 7/1995 | Smith |
| 5,472,057 | A | | 12/1995 | Winfree |
| 5,560,426 | A | | 10/1996 | Trahan et al. |
| 5,685,369 | A | | 11/1997 | Ellis et al. |
| 5,901,787 | A | | 5/1999 | Boyle |
| 5,957,195 | A | | 9/1999 | Bailey et al. |
| 6,021,850 | A | | 2/2000 | Wood et al. |
| 6,050,341 | A | | 4/2000 | Metcalf |
| 6,070,671 | A | | 6/2000 | Cumming et al. |
| 6,085,838 | A | | 7/2000 | Vercaemer et al. |
| 6,098,717 | A | | 8/2000 | Bailey et al. |
| 6,112,818 | A | | 9/2000 | Campbell |
| 6,135,208 | A | | 10/2000 | Gano et al. |
| 6,325,148 | B1 | | 12/2001 | Trahan et al. |
| 6,425,444 | B1 | | 7/2002 | Metcalfe et al. |
| 6,446,323 | B1 | | 9/2002 | Metcalfe et al. |
| 6,457,532 | B1 | | 10/2002 | Simpson |
| 6,470,966 | B2 | | 10/2002 | Cook et al. |
| 6,527,049 | B2 | | 3/2003 | Metcalfe et al. |
| 6,543,552 | B1 | | 4/2003 | Metcalfe |
| 6,688,397 | B2 | | 2/2004 | McClurkin et al. |
| 6,702,029 | B2 | | 3/2004 | Metcalfe et al. |
| 6,702,030 | B2 | | 3/2004 | Simpson |
| 6,752,215 | B2 | | 6/2004 | Maguire et al. |
| 6,860,329 | B1 | | 3/2005 | Oosterling |
| 7,172,025 | B2 | * | 2/2007 | Eckerlin ..... 166/380 |
| 2003/0155118 | A1 | | 8/2003 | Sonnier et al. |
| 2004/0168796 | A1 | | 9/2004 | Baugh et al. |
| 2005/0161226 | A1 | | 7/2005 | Duggan et al. |
| 2006/0052936 | A1 | | 3/2006 | Duggan et al. |

FOREIGN PATENT DOCUMENTS

| | | | |
|---|---|---|---|
| FR | 2 741 907 | | 6/1997 |
| GB | 1448304 | | 9/1976 |
| GB | 1457843 | | 12/1976 |
| GB | 2216926 | A | 10/1989 |
| GB | 2313860 | A | 12/1997 |
| GB | 2320734 | A | 7/1998 |
| GB | 2329918 | A | 4/1999 |
| RU | 2002035 | C1 | 7/1991 |
| RU | 2064357 | C1 | 7/1996 |
| RU | 2144128 | C1 | 10/2000 |
| SU | 1 745 873 | | 7/1992 |
| WO | WO 93/24728 | | 12/1993 |
| WO | WO 99/18328 | | 4/1999 |
| WO | WO 99/23354 | | 5/1999 |
| WO | WO 99/35368 | | 7/1999 |
| WO | WO 03/036012 | | 5/2003 |
| WO | WO 2004/097168 | | 11/2004 |

OTHER PUBLICATIONS

Canadian Office Action, Canadian Patent Application No. 2,356,194. dated Feb. 24, 2005.
GB Search Report, Application No. 0702917.6, Dated May 4, 2007.

* cited by examiner

METHOD AND APPARATUS FOR EXPANDING TUBULARS IN A WELLBORE

CROSS-REFERENCE TO RELATED APPLICATIONS

This application is related to co-pending U.S. patent application Ser. No. 10/869,458, filed Jun. 16, 2004, which is herein incorporated by reference.

BACKGROUND OF THE INVENTION

1. Field of the Invention

The invention relates to tubing expansion. In particular, the invention relates to methods and apparatus for expanding tubulars downhole, especially expanding discrete lengths of tubing downhole.

2. Description of the Related Art

Recently, methods and apparatus have been developed for placing tubular strings in a wellbore and then expanding the inner and outer diameters of the strings in order increase a fluid path through the tubulars and in some cases to line the walls of a wellbore. The advantages of expanding tubulars in a wellbore are obvious. The tubular strings are easier to assemble and run into the wellbore prior to being expanding and are typically less expensive. There are many examples of downhole expansion of tubulars including patents owned by the assignee of the present invention. U.S. Pat. No. 6,457,532 assigned to Weatherford/Lamb, Inc. discloses a number of methods for downhole expansion including an expansion tool which combines compliant and non-compliant expansion means.

In some instances, it is necessary to place a discrete length of tubing in a wellbore either to line a specific area of the bore or for remedial purposes when a section of tubular casing has become damaged. Expanding discrete lengths of tubing in a wellbore is a complicated process because the pre-expanded tubing must be run to depth and held with some other tubular string downhole before and during expansion. Prior art procedures include a method wherein a discrete length of unexpanded tubular is run into a wellbore on a separate, smaller work string and thereafter, using an anchor and an expansion cone, the string is anchored to the wellbore wall and then expanded as the cone is urged upwards or downwards relative to the string.

It is among the objectives of the embodiments of this invention of provide improved and/or additional methods and apparatus for expanding tubulars.

SUMMARY OF THE INVENTION

The present invention provides methods and apparatus to expand tubulars in a wellbore. In one embodiment, a method of expanding a tubular includes providing a first tubular string having an expansion member disposed at a lower end and connected with a threaded connection which will permit movement of the expansion member relative to the tubular string. The tubular string is held at the surface of the well while a second, smaller string is run into the first tubular string and engaged with the expansion member. Thereafter, the assembly including the first tubular string, expansion member and second tubular string are run to depth in a wellbore. Finally, the expansion member is urged upwards into the tubular string to expand the tubular string and bring it into frictional contact with surrounding wellbore walls. The initial expansion can be performed with a hydraulic jack and additional expansion can be performed by urging the cone upwards with the second tubular string.

DETAILED DESCRIPTION

Published patent application U.S. 2005/0161226 entitled "TUBING EXPANSION" and owned by the assignee of the present invention discloses various methods and apparatus for expanding a discrete length of tubular in a wellbore. That published patent application is incorporated herein by reference in its entirety.

Figure 1:
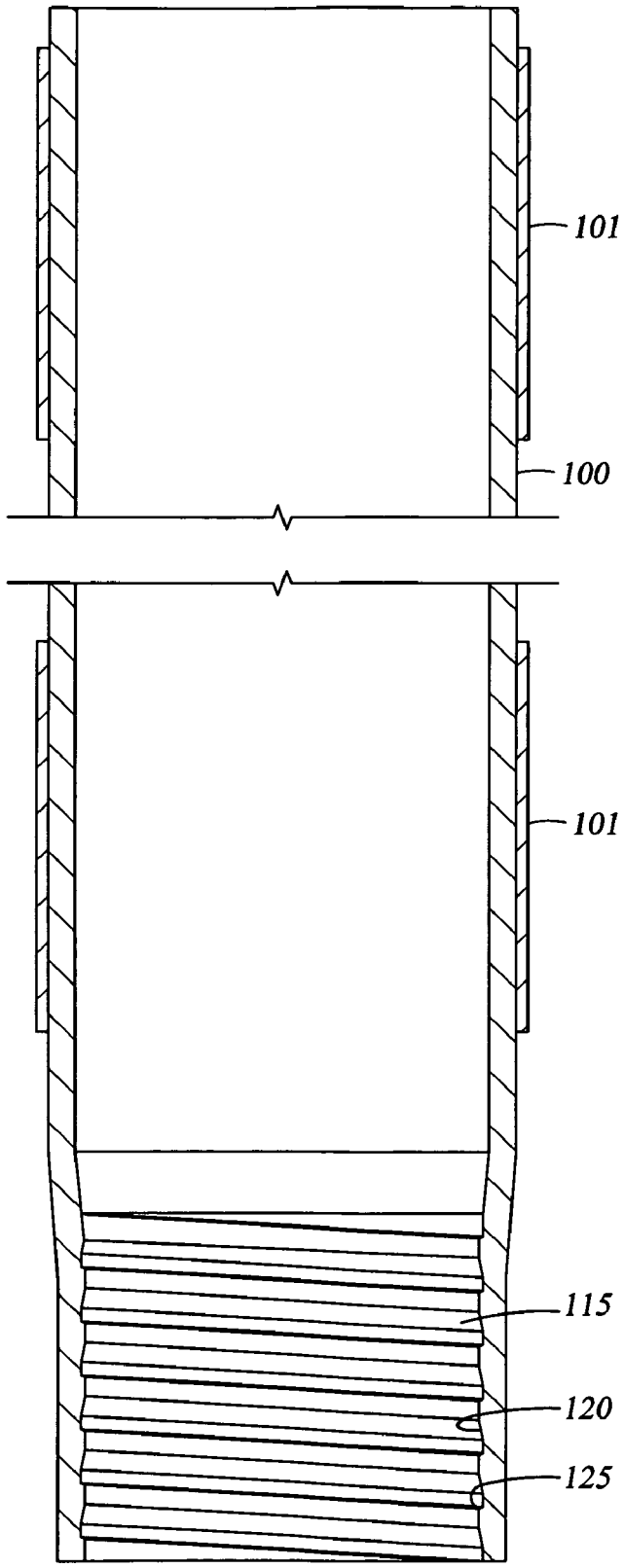
FIG. 1 is a section view of a first tubular string having a tapered lower end portion with female buttress threads formed on an inner diameter thereof.

FIG. 1 is a section view showing the lower end of a first tubular string 100. The first tubular string would typically be a string of liner for disposal and expansion in a wellbore. For instance, the string could be hundreds of feet long but designed to be expanded at some discrete location in a wellbore and therefore must be transported into the wellbore to a predetermined location prior to expansion. Each end of the first tubular string 100 can include sealing/anchoring sections such as anchors 101 disposed on an outer surface thereof. Female buttress threads 115 formed in an inner surface of the bottom portion of the liner include a sloped portion 120 and a steep portion 125. As will be clear, the threads are designed to receive an expansion member and to retain the member axially from downward movement but to permit the member to deform and move upwards in the first tubular string as expansion takes place. In a preferred embodiment of FIG. 1, the lower end of the first tubular string in the area of the female buttress threads 115 is tapered to facilitate the movement of an expansion member upwards as explained with reference to FIG. 4.

Figure 2:
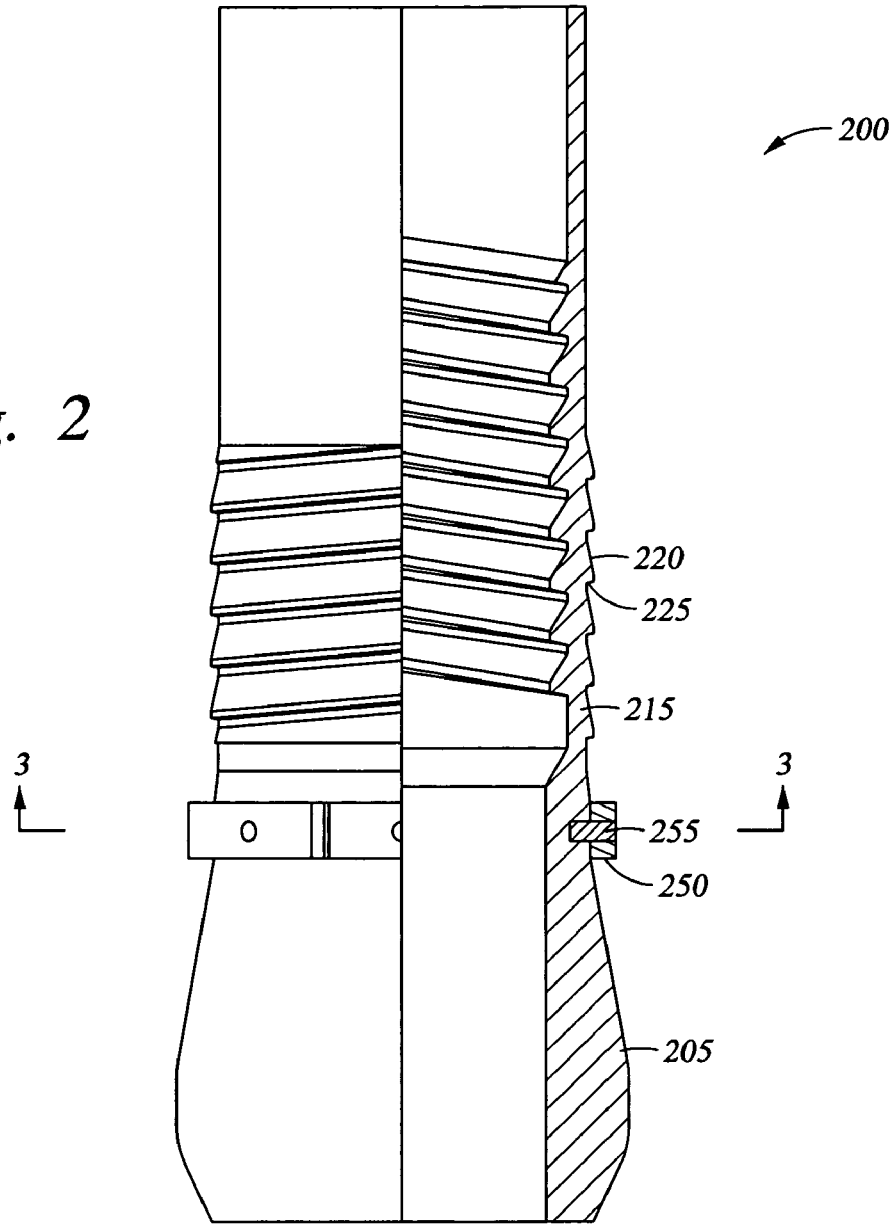
FIG. 2 is a partial section view of an expansion member having a cone portion and having male buttress threads formed on an outer diameter thereof.

FIG. 2 is a partial section view of an expansion member 200 that includes an enlarged cone portion 205 and male buttress threads 215 which are designed with a steep portion 225 and a sloped portion 220 corresponding to the female buttress threads 115 formed on the inner surface of the first tubular string 100. The expansion member is designed to be threadedly attached at a lower end of the first tubular string prior to disposal in a wellbore. Typically, the cone will be installed at a lower end of a first section of the tubular string 100 and then the string will be built and held from the surface of the well with a slip device, like a spider.

Figure 3:
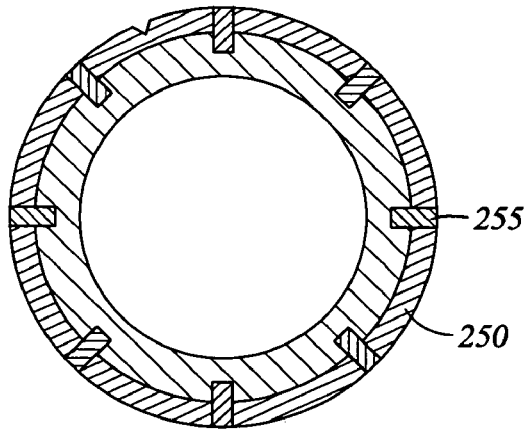
FIG. 3 is a section view taken along a line 3-3 of FIG. 2 and shows a lock ring assembly.

FIG. 3 is a section view along line 3-3 of FIG. 2 and illustrates an optional locking ring 250 held in place by radially disposed pins 255 which are shearable. Weight of the tubular string 100 can provide a downward force to the tubular string relative to the expansion member 200 that is supported from above. The ring 250 ensures prevention of premature movement of the expansion member relative to the tubular string 100 as will be explained herein. For some embodiments, the threads 115, 215 alone provide this prevention of premature movement due to interactions along the mating sloped portions 220, 120 of the threads. One or more shearable members such as a shear pin 260 (shown in FIG. 4) can for some embodiments be disposed through an aperture in the wall of the tubular string and into a recess in the expansion member 200 to temporarily prevent relative movement between the tubular string 100 and the expansion member 200. Accordingly, the shear pin 260 can be used alone or in combination with the threads 115, 215 and/or the ring 250.

Figure 4:
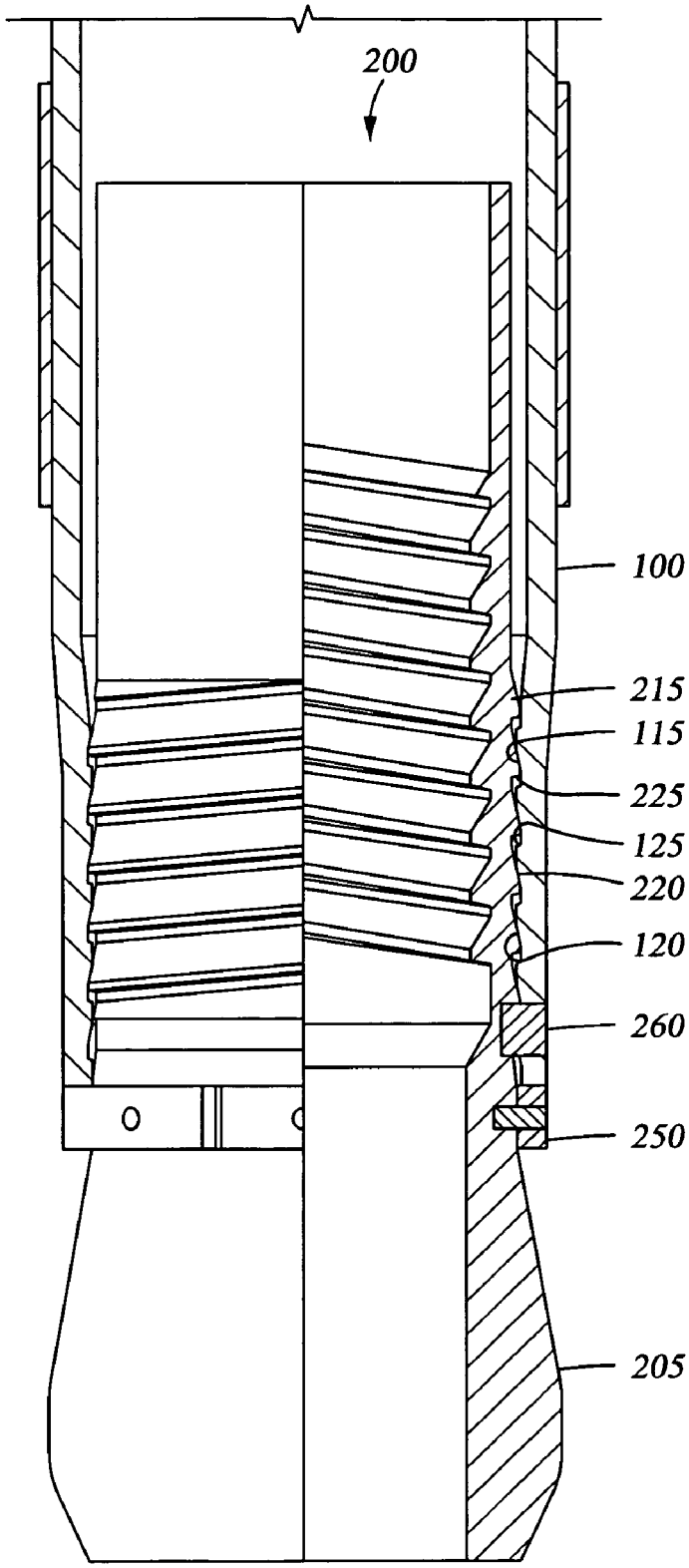
FIG. 4 is a partial section view illustrating the expansion member installed in the first tubular string utilizing the mating buttress threads on the expansion member and the inner diameter of the tubular string.

FIG. 4 is a partial section view illustrating the relationship of the expansion member 200 and the lower end of the tubular string 100 with the expansion member installed therein. Specifically, the relationship of the mating buttress threads 115, 215 can be appreciated and it can be seen that upward movement of the expansion cone relative to the tubular string is facilitated due to the mating sloped portions 220 and 120 of the threads. Conversely, downward movement of the cone relative to the tubular string requires considerable more force as the steep portions of the threads 225, 125 are abutting one another. In this manner, the expansion member is maintained at a lower end of the tubular string and inadvertent downward movement is avoided while upward movement to place the cone portion 205 of the expansion member in contact with the inner surface of the tubular string is facilitated.

The ring 250 is formed as an outer surface of the expansion member 200 in a location where it interfaces with upward movement of the expander device relative to the tubular string 100. The purpose of the ring as will be explained, is to prevent inadvertent movement of the expander device relative to the tubular during run in. The tapered design of the lower end of the tubular string 100 ensures that the male threads of the expansion member will not interface with the inner surface of the tubular string 100 as the cone portion 205 of the expansion member moves upwards in the string. For some embodiments, the tapered design is not necessary depending on, for example, characteristics of the tubular string 100 that the threads 115 are cut into.

Figure 5:
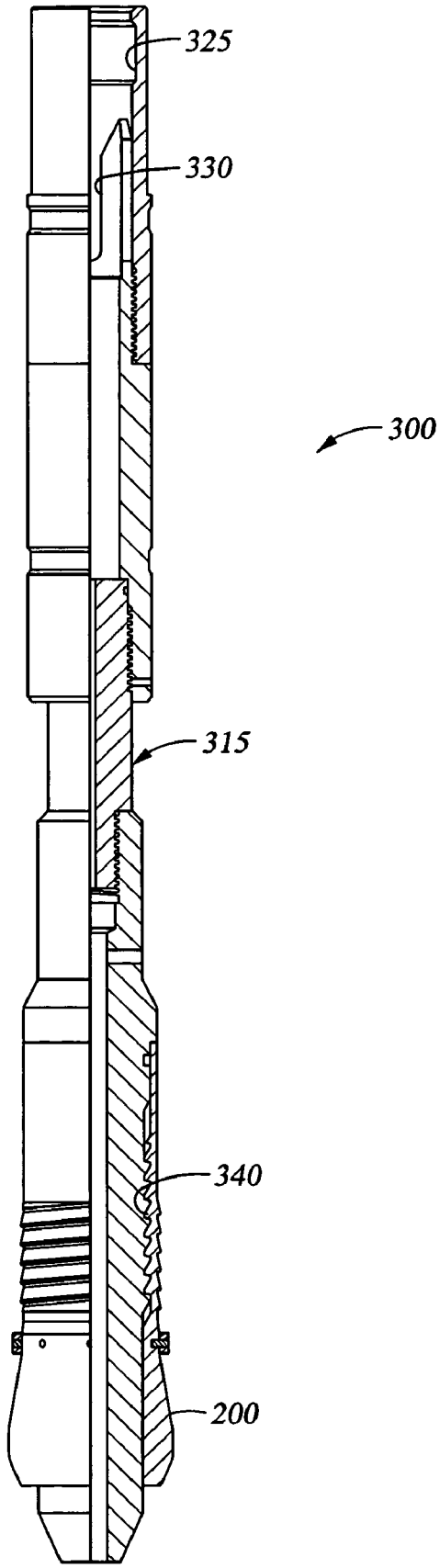
FIG. 5 is an expansion member subassembly that includes the expansion member and a mandrel portion including an internally formed latching profile and slots for keys.

FIG. 5 shows an expansion member subassembly 300 that includes the expansion member 200 and a mandrel portion 315 including an internally formed latching profile 325 and slots 330 for keys. Prior to installation at the surface of the well into the lower end of tubular string 100, the expansion member subassembly 300 is put together. In use, the expansion member 200 runs into the wellbore along with the mandrel portion 315. The subassembly includes the latching profile 325 formed in an inner surface and also the key slots 330 which will permit the subassembly 300 to be rotationally fixed to a smaller tubular string.

Figure 6:
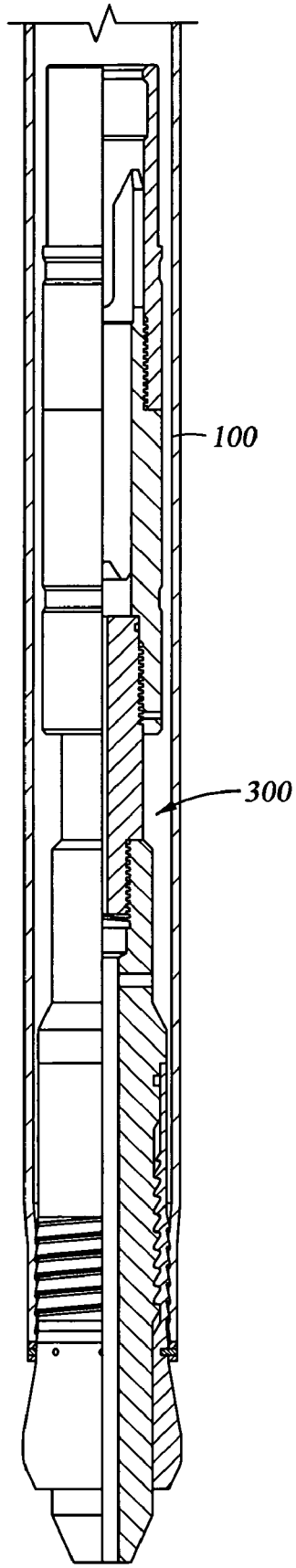
FIG. 6 illustrates the expansion member assembly disposed in a lower end of the first tubular string as it would appear while the first tubular string is suspended from the surface of a wellbore.

FIG. 6 illustrates the expansion member subassembly 300 installed in a lower end of the tubular string 100 as it would appear when run into a wellbore.

Figure 7:
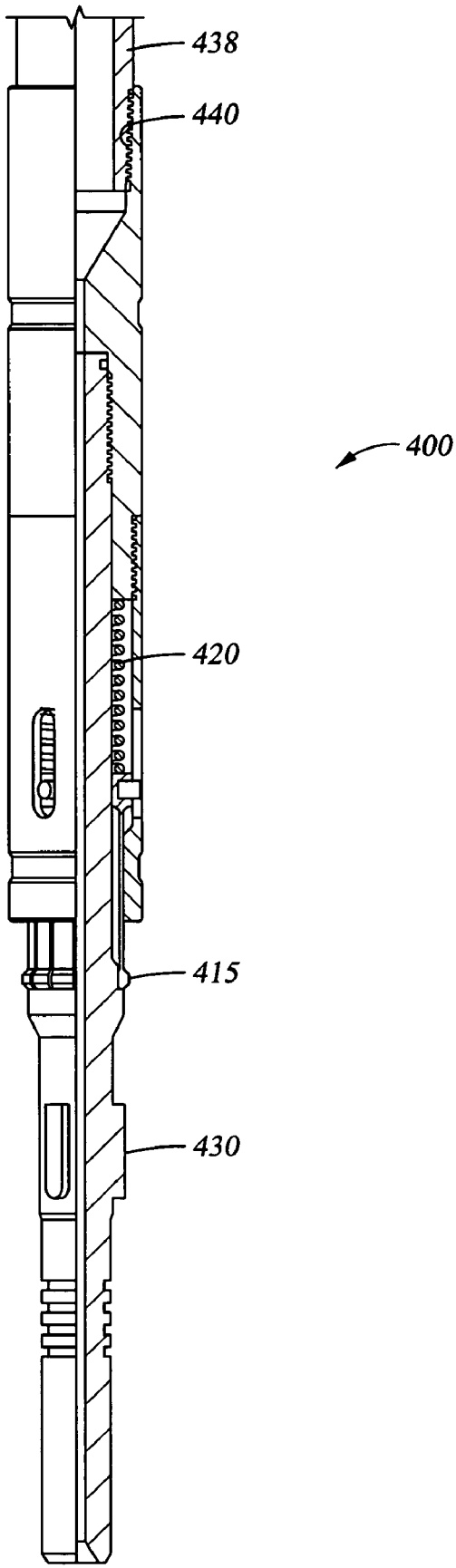
FIG. 7 is a latch assembly for installation on a lower end of a second smaller tubular string and is construed and arranged to mate with the expansion member assembly downhole.

FIG. 7 is a partial section view of a latch assembly 400. The latch assembly is designed to be connected at a lower end of a second, smaller tubular string 438 to be built and installed into the first tubular string after the first tubular string, including the expansion member assembly has been assembled and is being suspended from the surface of the wellbore. The latch assembly 400 includes a means for connection to the second tubular string, like a threaded connection 440. It also includes a latch which is illustrated as a collet 415 and a biasing member 420 which permits spring loaded functioning of the latch. Other latches or connecting arrangements, such as a threaded coupling, are contemplated in place of the collet 415. The collet 415 is designed with fingers which mate to the latching profile 425 formed in the inner diameter of the expansion member subassembly 300. Also included in the latch assembly are keys 430 extending outward from a surface of the assembly for mating with slots 330 formed in the interior of the expansion member subassembly.

Figure 8:
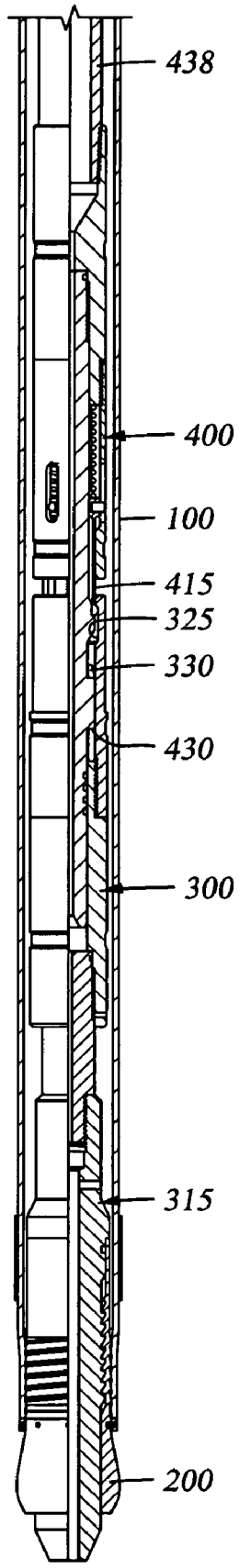
FIG. 8 is a section view showing the latch assembly mated to the expansion member assembly within the first tubular string prior to expansion.

FIG. 8 illustrates the expansion member subassembly 300 installed in the lower end of first tubular string 100 and latch assembly 400 which is then landed and connected to the expansion member subassembly. The relationship between the collet 415 and internal profile 325 is visible in the figure as is the relationship between the keys 430 and the key slots 330 of the expansion member assembly. The keys and slots rotationally fix the second tubular string 438 to the expansion member making it possible, in an emergency, to unthread the mandrel 315 from the expansion member 200 at a threaded connection 340 (shown in FIG. 5). Typically, the latch assembly is run in at the lower end of the smaller, second tubular string and landed in the expansion member subassembly. Thereafter, the second tubular string can bear the weight of the entire expansion assembly as well as the first tubular string.

Upon unthreading the mandrel 315 from the expansion member 200 at the threaded connection 340 in an emergency or stuck condition of the expansion member 200, the second tubular string 438 can be removed. The expansion member 200 can subsequently be pushed to the bottom of the borehole. Furthermore, another expansion device can be lowered to expand at least a top portion of the first tubular string 100 to form a straddle as may have been intended by the original operation. While the threaded connection 340 is shown, some embodiments include any releasable connection, such as a hydraulic releasable connection, to enable selective release of the second tubular string 438 from the expandable member 200 and/or the expansion member subassembly 300.

In operation, the assembly can function as follows:

The expansion member subassembly 300 is assembled by connecting the expansion member 200 to the mandrel 315 along the threaded connection 340, which is illustrated in FIG. 5. The threaded connection 340 permits separation of the mandrel and expansion member in an emergency. Once the expansion member subassembly is assembled, it is installed into a lower end of the first tubular string 100 utilizing the mating buttress threads that have been described herein. The design of the threads with their steep portions and/or the shear pins prevents the expansion subassembly 300 from falling out of the first tubular string 100. Thus, the expansion member 200 is suspended from the first tubular string 100. Thereafter, the first tubular string 100 is built with sequential joints of tubing with its weight maintained from the surface of the well, typically by using some type of spider or other bowl-shaped device with slips that engage the tubular in a wedge-like fashion. Once tubular string 100 is completely assembled, the smaller tubular string 438 is assembled with the latch assembly 400 of FIG. 7 installed at a lower end thereof. The second tubular string is assembled to a length making it passable to "sting" the latch assembly into the internal profile of the expansion member assembly. Thereafter, the first tubular string can be released from the surface and the entire weight of the tubular string and the expansion assembly is born by the buttress threads 115, 215 between the expansion member 200 and the lower portion of tubular string 100. Premature movement of the expansion member relative to the tubular 100 is prevented by one or more of the threads 115, 215, the ring 250 and/or the shear pin 260 as previously discussed.

At this point, the tubular string 100 is lowered to a predetermined location in the wellbore using the smaller second tubular string as the run in string. Upon arriving at a location where the first tubular string is to be expanded into engagement with the wellbore walls, the expansion member is urged upwardly relative to the lower end of tubular string 100 in order to deform the lower end of the string, including the threads and to place an anchor into frictional contact with the walls of the wellbore surrounding the lower end of the string 100. Causing the expansion member to move upwardly relative to tubular string 100 is typically preformed using a hydraulic jack having, for example, a 5' stroke and operable due to fluid which is supplied and circulated from the second tubular string. Hydraulic jacks are well known in the art to permit limited movement of one wellbore component relative to another and a typical jack is disclosed in the '226 publication already incorporated by reference herein. The force provided by the jack is designed to overcome the holding ability of, for example, sloped portions of the threads 115, 215 and/or the shear pin 260 (shown in FIG. 4) and cause the ring 250, if present, to fail. Thereafter, the force from the jack begins moving the cone shaped portion 205 of the expander device through the tubular string 100.

Figure 9:
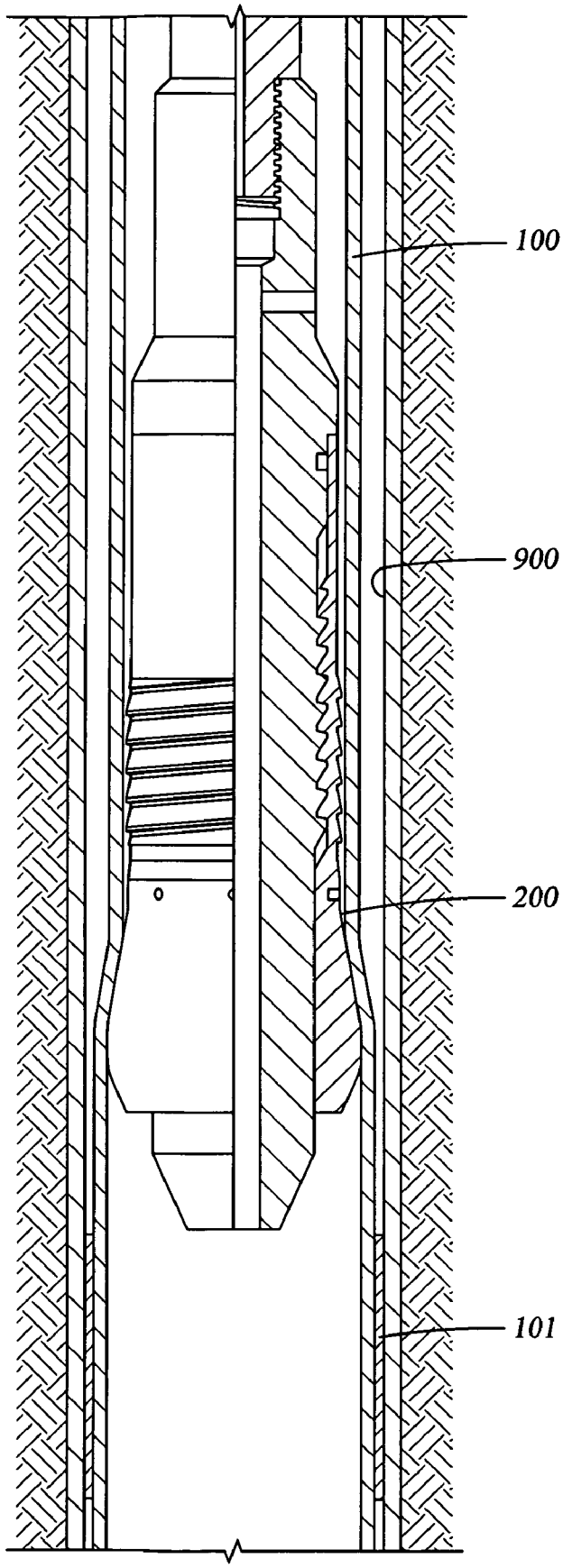
FIG. 9 is a section view showing the expansion member placing the first tubular into frictional contact with a cased wall of a wellbore.

FIG. 9 shows the tubular string 100 being expanded to a diameter wherein the anchor 101 is in frictional contact with the wall of a surrounding wellbore 900. The anchor which is used to frictionally maintain the first tubular string in contact with the wellbore wall can be any type of member that surrounds the tubular in one location and typically includes gripping and possibly sealing properties on an outer surface thereof to engage and grip the surrounding wellbore and prevent axial and rotational movement of the tubular string 100. Once the tubular string 100 is frictionally held by the wellbore walls, the second string (not visible) which is connected to the expansion member 200 can simply be urged upward bringing the expansion member upwards and expanding the first tubular string into contact with the walls of the wellbore. In typical patching operations, the entire tubular string would be expanded.

Embodiments of the invention are not limited to the expansion member 200 illustrated heretofore with the cone portion 205 that can have a fixed outer diameter. For some embodiments, the expansion member can be any expansion device for expanding a tubular. For example, the expansion member can have a variable diameter, be collapsible, be inflatable or hydraulically actuated or combine compliant and non-compliant expanders, such as roller expanders disclosed in the aforementioned '532 patent.

While the foregoing is directed to embodiments of the present invention, other and further embodiments of the invention may be devised without departing from the basic scope thereof, and the scope thereof is determined by the claims that follow.

What is claimed is:

1. A method of expanding a tubular in a wellbore, comprising:

providing a first tubular string having upper and lower ends and having an expansion member disposed adjacent the lower end, the expansion member having an outer diameter greater than an inner diameter of the first tubular string and attached to the first tubular string with a threaded connection permitting movement of the expansion member relative to the first tubular string in a first direction;

locating the first tubular string in the wellbore while supporting the upper end of the first tubular string from well surface;

running a second tubular string into the wellbore, the second tubular string inserted inside the first tubular string and having a latch disposed at a lower end thereof;

attaching the second tubular string to the expansion member utilizing the latch and a mating profile in the expansion member;

releasing the first tubular string at the well surface;

lowering the first tubular string to a predetermined location in the wellbore with the second tubular string;

securing the first tubular string to enable movement of the expansion member;

moving the expansion member in the first direction relative to the first tubular string to expand the lower portion in an area of the threaded connection and thereby bringing the outer surface of the lower end into frictional contact with the wellbore, wherein the expansion member is released from the threaded connection by movement of the expansion member in the first direction; and continuing to move the expansion member in the first direction, thereby expanding an inner and outer diameter of the first tubular string.

2. The method of claim 1, wherein the threaded connection comprises buttress threads.

3. An expansion assembly for use in a wellbore, comprising:

an expansion member including a cone portion and a threaded portion; and a tubing portion having threads located in a first section of the tubing portion having a reduced inner diameter relative to a second section of the tubing portion, the expansion member matable to the tubing portion via the threads, wherein the threads are arranged to permit movement of the expansion member in a first direction relative to the tubing portion with the application of a first force, the first force smaller than a second force necessary to move the expansion member in a second direction wherein the expansion member is releasable from the threads of the tubing portion by movement of the expansion member in the first direction.

4. The expansion assembly of claim 3, wherein the threads are internally formed in the tubing portion to mate with a male section defined by the threaded portion of the expansion member.

5. The expansion assembly of claim 3, wherein the first direction is a direction urging the cone portion into contact with the tubing portion.

6. The expansion assembly of claim 3, wherein the threads comprise buttress threads.

7. An expansion assembly for use in a wellbore, comprising:

an expansion member including a cone portion and a threaded portion;

a tubing portion having threads, the expansion member matable to the tubing portion via the threads, wherein the threads are arranged to permit movement of the expansion member in a first direction relative to the tubing portion with the application of a first force, the first force smaller than a second force necessary to move the expansion member in a second direction, wherein the expansion member is releasable from the threads of the tubing portion by movement of the expansion member in the first direction; and a shearable member for temporarily connecting the tubing portion and the expansion member.

8. The expansion assembly of claim 7, wherein the shearable member comprises a locking ring coupled to the expansion member and disposed at a bottom edge of the tubing portion between the cone portion and the tubing portion.

9. An expansion assembly for use in a wellbore, comprising:

an expansion member including a cone portion and a threaded portion;

a tubing portion having threads, the expansion member matable to the tubing portion via the threads, wherein the threads are arranged to permit movement of the expansion member in a first direction relative to the tubing portion with the application of a first force, the first force smaller than a second force necessary to move the expansion member in a second direction, wherein the expansion member is releasable from the threads of the tubing portion by movement of the expansion member in the first direction; and an expansion subassembly including the expansion member and a mandrel portion threaded into an interior portion of the expansion member.

10. An expansion assembly for use in a wellbore, comprising:

an expansion member including a cone portion and a threaded portion;

a tubing portion having threads, the expansion member matable to the tubing portion via the threads, wherein the threads are arranged to permit movement of the expansion member in a first direction relative to the tubing portion with the application of a first force, the first force smaller than a second force necessary to move the expansion member in a second direction, wherein the expansion member is releasable from the threads of the tubing portion by movement of the expansion member in the first direction; and an expansion subassembly including the expansion member and a mandrel portion, wherein the mandrel portion is coupled to the expansion member and has a latching arrangement disposed completely within the tubing portion and unconnected to a mating latching arrangement.

11. The expansion assembly of claim 9, wherein the mandrel portion has a latching arrangement for providing a rotationally and longitudinally fixed connection with a mating latching arrangement.

12. A method of expanding a tubular string in a wellbore, comprising:

threadedly connecting an expander member to a lower end of a tubular member, the expander member having a cone portion extending from the lower end and having a larger outer diameter than an inner diameter of the tubular member; and urging the expander member in a first direction to move relative to the lower end such that the cone portion contacts and expands part of the lower end including where the tubular member was previously threadedly connected to the expander member, wherein the expander member is released from the threaded connection by movement of the expander member in the first direction.

13. The method of claim 12, wherein urging the expander member includes applying a longitudinal force to the expander member with the tubular member coupled to the expander member.

14. A method of expanding a tubular in a wellbore, comprising:

providing a first tubular string having upper and lower ends and having an expansion member suspended from the lower end;

locating the first tubular string in the wellbore while supporting the upper end of the first tubular string from well surface;

running a second tubular string into the first tubular string that is supported in the wellbore;

attaching the second tubular string to the expansion member;

releasing the first tubular string at the well surface;

lowering the first tubular string to a location in the wellbore with the second tubular string;

securing the first tubular string to enable movement of the expansion member; and moving the expansion member in a first direction relative to the first tubular string to expand the lower portion, wherein the expansion member is released from the lower end by movement of the expansion member in the first direction.

15. The method of claim 14, wherein moving the expansion member relative to the first tubular string releases a connection between the expansion member and the first tubular string.

16. The method of claim 14, wherein the expansion member is releasable from the first tubular string in only one longitudinal direction relative to the first tubular string.

17. The method of claim 14, wherein the expansion member is releasably connected to the first tubular string by buttress threads formed on an outer surface of the expansion member and an inner surface of the first tubular string.

18. The method of claim 14, wherein moving the expansion member relative to the first tubular string shears a connection between the expansion member and the first tubular string.

19. The method of claim 14, wherein attaching the second tubular string to the expansion member includes making a connection inside the first tubular string.

20. The method of claim 14, wherein the expansion member includes a cone portion disposed outside of the first tubular string prior to moving the expansion member relative to the first tubular string to expand the lower portion.

21. The method of claim 14, wherein the expansion member has a non-fixed outer diameter.

22. The method of claim 14, wherein the expansion member is releasably connected to the first tubular string by threads formed on an outer surface of the expansion member and an inner surface of the first tubular string.

23. An expansion assembly for use in a wellbore, comprising:

an expander member threadedly connected to a lower end of a tubular member, the expander member having a cone portion extending from the lower end and having a larger outer diameter than an inner diameter of the tubular member, wherein the expander member is movable in a first direction relative to the lower end such that the cone portion contacts and expands part of the lower end including where the tubular member is initially threadedly connected to the expander member prior to the expander member being moved relative to the lower end, wherein the expander member is releasable from the threaded connection by movement of the expander member in the first direction.

24. A method of expanding a tubular in a wellbore, comprising:

providing a first tubular string having upper and lower ends and having an expansion member coupled to the lower end of the first tubular string;

locating the first tubular string in the wellbore while supporting the upper end of the first tubular string from well surface;

running a second tubular string in the wellbore and into the first tubular string that is supported from well surface;

attaching the second tubular string to the expansion member after the second tubular string is run into the first tubular string;

releasing the first tubular string at the well surface;

lowering the first tubular string to a location in the wellbore with the second tubular string;

securing the first tubular string to enable movement of the expansion member; and moving the expansion member relative to the first tubular string to expand the lower end of the first tubular string.

25. The method of claim 24, wherein the second tubular string is run into the wellbore apart from the first tubular string that is supported from well surface.

26. The method of claim 24, wherein the first tubular string is secured relative to the second tubular string using a hydraulic jack.

27. The method of claim 1, wherein the second tubular string is run into the wellbore apart from the first tubular string that is supported from well surface.

28. The method of claim 1, wherein the second tubular string is attached to the expansion member after the first tubular string is located in the wellbore.

29. The method of claim 1, wherein the first tubular string is secured relative to the second tubular string using a hydraulic jack.

30. The assembly of claim 7, wherein the shearable member is partially disposed through at least one of the first tubular and the expansion member.

31. The method of claim 14, wherein the first tubular string is secured relative to the second tubular string using a hydraulic jack.

* * * * *